US006889507B1

(12) United States Patent
Claydon et al.

(10) Patent No.: US 6,889,507 B1
(45) Date of Patent: May 10, 2005

(54) SELF-COOLING CAN

(75) Inventors: Paul Charles Claydon, Oxon (GB); Paul Robert Dunwoody, Oxon (GB); Stephen Robert Arnell, Swindon (GB); Christopher Paul Ramsey, Wantage (GB); Michael Stephane Spottiswoode, Oxford (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 473 days.

(21) Appl. No.: 10/048,321

(22) PCT Filed: Aug. 2, 2000

(86) PCT No.: PCT/GB00/02986

§ 371 (c)(1),
(2), (4) Date: Jan. 29, 2002

(87) PCT Pub. No.: WO01/11297

PCT Pub. Date: Feb. 15, 2001

(30) Foreign Application Priority Data

Aug. 4, 1999 (GB) ..... 9918318
Nov. 30, 1999 (GB) ..... 9928153

(51) Int. Cl.[7] ..... F25D 5/00
(52) U.S. Cl. ..... 62/4; 62/293; 62/294
(58) Field of Search ..... 62/4, 293, 294

(56) References Cited

U.S. PATENT DOCUMENTS

| | | | | |
|---|---|---|---|---|
| 3,010,598 A | | 11/1961 | Foss | 220/4 |
| 3,889,483 A | * | 6/1975 | Donnelly | 126/263.07 |
| 3,970,068 A | | 7/1976 | Sato | 126/263 |
| 4,174,035 A | | 11/1979 | Wiegner | 206/222 |
| 4,669,273 A | | 6/1987 | Fischer et al. | 62/294 |
| 4,673,099 A | * | 6/1987 | Wells | 220/258.5 |
| 4,736,599 A | | 4/1988 | Siegel | 62/294 |
| 4,759,191 A | | 7/1988 | Thomas et al. | 62/101 |
| 4,901,535 A | | 2/1990 | Sabin et al. | 62/101 |
| 4,911,740 A | | 3/1990 | Schieder | 62/4 |
| 4,928,495 A | | 5/1990 | Siegel | 62/4 |
| 4,949,549 A | | 8/1990 | Steidl et al. | 62/101 |
| 4,974,419 A | | 12/1990 | Sabin et al. | 62/101 |
| 4,993,239 A | | 2/1991 | Steidl et al. | 62/480 |
| 5,018,368 A | | 5/1991 | Steidl et al. | 62/480 |
| 5,048,301 A | | 9/1991 | Sabin et al. | 62/101 |
| 5,079,932 A | | 1/1992 | Siegel | 62/293 |
| 5,168,708 A | | 12/1992 | Siegel | 62/4 |
| 5,197,302 A | | 3/1993 | Sabin et al. | 62/477 |
| 5,230,216 A | | 7/1993 | Siegel | 62/4 |
| 5,233,836 A | | 8/1993 | Siegel | 62/4 |

(Continued)

FOREIGN PATENT DOCUMENTS

| | | |
|---|---|---|
| DE | 19812657 | 12/1998 |
| EP | 0 297 724 | 1/1989 |
| EP | 0 752 564 A2 | 1/1997 |
| EP | 0 931 998 A2 | 7/1999 |
| GB | 2 307 543 | 5/1997 |
| GB | 2 329 459 | 3/1999 |
| GB | 2 329 461 | 3/1999 |
| GB | 2 333 586 | 7/1999 |
| WO | WO 91/05976 | 5/1991 |
| WO | WO 99/48772 | 3/1999 |
| WO | WO 99/37958 | 7/1999 |
| WO | WO 01/10738 | 2/2001 |

*Primary Examiner*—William E. Tapolcai
*Assistant Examiner*—Mohammad M. Ali
(74) *Attorney, Agent, or Firm*—Woodcock Washburn LLP

(57) ABSTRACT

A self-cooling can comprising an evaporator unit within the can and an absorber unit provided outside the container body. A beverage within the can is cooled by means of vapor which passes from the evaporator to the absorber when these are connected so as to provide a vapor path between the two. The path for water vapor, for example, to pass from the evaporator to the absorber is formed by rupturing a pane between the evaporator and the absorber when the can and part or all of the absorber are rotated relative to each other.

22 Claims, 10 Drawing Sheets

U.S. PATENT DOCUMENTS 5,282,368 A * 2/1994 Ordoukhanian ..... 248/214
5,313,799 A 5/1994 Siegel ..... 62/4
5,331,817 A 7/1994 Anthony ..... 62/5
5,447,039 A 9/1995 Allison ..... 62/293
5,626,022 A * 5/1997 Scudder et al. ..... 126/263.01
5,655,384 A 8/1997 Joslin, Jr. ..... 62/294
5,845,501 A * 12/1998 Stonehouse et al. ..... 62/293
6,103,280 A 8/2000 Molzahn et al. ..... 426/109
6,126,032 A 10/2000 Herzog et al. ..... 220/501
6,141,970 A 11/2000 Molzahn et al. ..... 62/4
6,151,911 A 11/2000 Dando et al. ..... 62/457.3
6,170,283 B1 * 1/2001 Anthony ..... 62/294
6,178,753 B1 * 1/2001 Scudder et al. ..... 126/263.08
6,247,586 B1 6/2001 Herzog et al. ..... 206/221
6,341,491 B1 * 1/2002 Paine et al. ..... 62/380

* cited by examiner

SELF-COOLING CAN

This invention relates to a self-cooling can. In particular, it relates to a can suitable for containing beverage which includes a refrigeration device within and/or attached to the can so that cooling may be initiated at any time and anywhere, remote from a domestic/commercial refrigerator.

The principles of refrigeration are well-established, using refrigerant in an evaporator to extract heat from the refrigeration compartment (or freezer compartment, as applicable) and then releasing heat from the refrigerant by means of a compressor and condenser or, alternatively, in an absorber.

One problem associated with adapting known refrigerating units for cooling a beverage in a can is that initiation of the cooling process should ideally be a simple procedure for the consumer to carry out.

A further problem is the time taken to cool the volume of liquid to a desired drinking temperature. The flow of liquid/vapour through a miniature refrigeration device and the choice of refrigerant may be limiting factors in this. Clearly a non-toxic refrigerant is at least desirable and possibly essential for use with beverage.

None of the phase change devices proposed to date are considered suitable for cooling a product within a can due to the loss of can capacity available for the product itself.

The Applicant's GB patent application no. 9918318.8 (copending PCT application PCT/GB00/02983) proposes a self-cooling can in which an absorber unit is provided outside the can body which is connectable to an evaporator which is either within the can itself or forms part of the can wall. The product, such as beverage, is preferably cooled by means of vapour which passes from the evaporator to the absorber when the evaporator and absorber are connected such that a vapour path is formed by the connection. Cooling is thus achieved mainly by natural convection and conduction due to the evaporator being at a lower temperature than the product. However, if an absorber unit is used which is external to the can so that only the evaporator will reduce the can capacity available for beverage, there is greater difficulty in achieving the path for water vapour from the evaporator to the absorber.

According to the present invention, there is provided a self-cooling can having a cylindrical can body and comprising: an evaporator for cooling a product within the can body; an absorber unit mounted at least partially on the outside of the can body; a rupturable panel comprising one or more gas impermeable layers for separating the evaporator from the absorber unit; one or more seals for preventing gas penetration of the evaporator and/or absorber; a cutter; and an actuator for moving the panel and cutter relative to each other to cause the cutter to penetrate the panel, thereby providing a passage for vapour from the evaporator to the absorber to initiate cooling.

The rupturable panel may comprise two or more layers of foil bonded together by an adhesive such as a hot melt adhesive, or a seal/sealant, for example silicone sealant. The laminate thus formed is capable of shear for rupture of the panel and not only excludes all air from the seal but also prevents air penetration both before and after rupture.

Preferably, one foil is bonded to the absorber and a second foil is bonded to a desiccant unit within the absorber. The two foils may contact each other in a central portion, from which all air is displaced, and be sealed together around the central portion. Alternatively, there may be a space between the two foils which is filled by sealant or glue.

The seal between the foil layers may be a gasket which may act as a rotating seal if suitably lubricious.

Alternatively the panel may be a scored area on the base of the can adjacent a foil on the absorber. In this embodiment, the actuator may rupture the panel by pushing out both the scored area on the can base and the absorber foil. Variants of this include a foil on the base of the can and a scored area on the absorber, or both can and absorber having a foil, or both can and absorber having a scored area.

The actuator may include a deformable member which may be a bistable portion of the absorber unit, typically a diaphragm or part of the base of the absorber. The actuator may also include means for deforming the deformable member, such as a rotary pusher, cam profile or screw threaded cap which is rotatable upwardly against the deformable member. The cutter may be a spike, which is usually porous and may be axially moveable.

Preferred embodiments of the invention will now be described, with reference to the drawings, in which.

Figure 4:
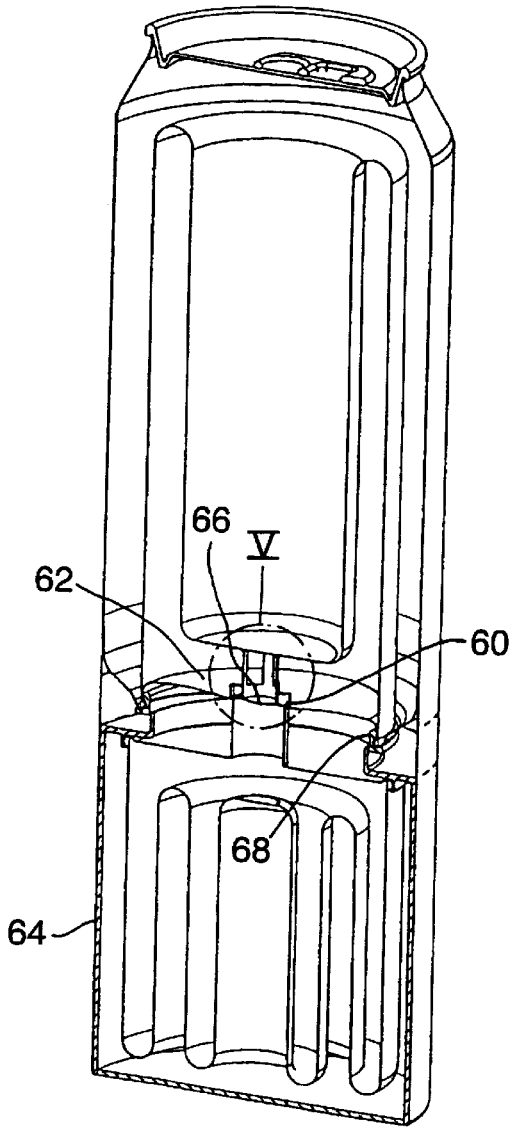
FIG. 4 is a side section perspective view of the third embodiment of the invention.
Figure 5A:
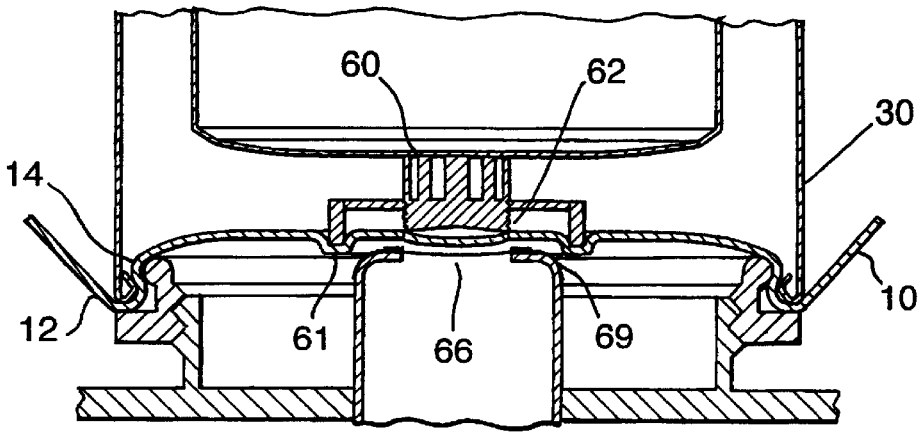
Figure 5B:
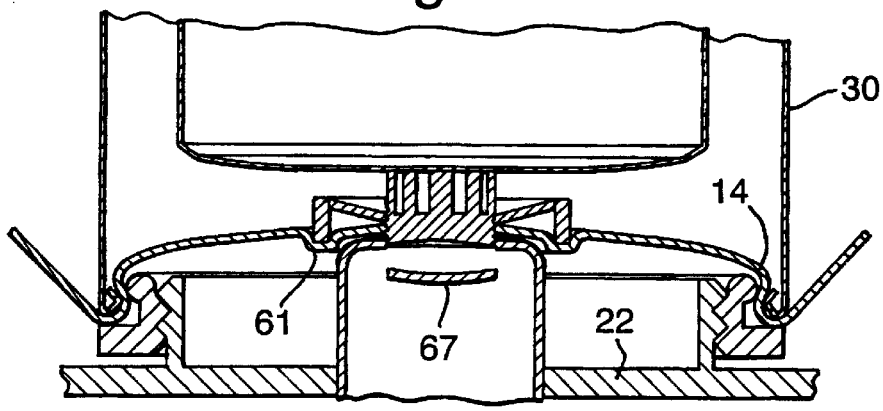
Figure 6A:
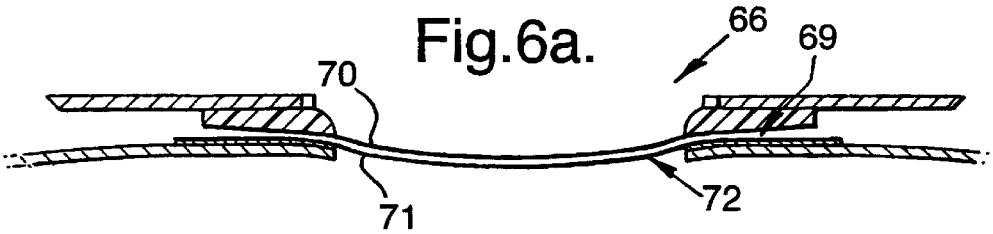
Figure 6B:
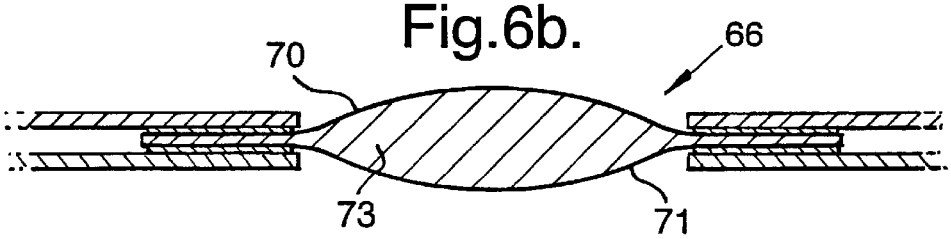
Figure 7B:
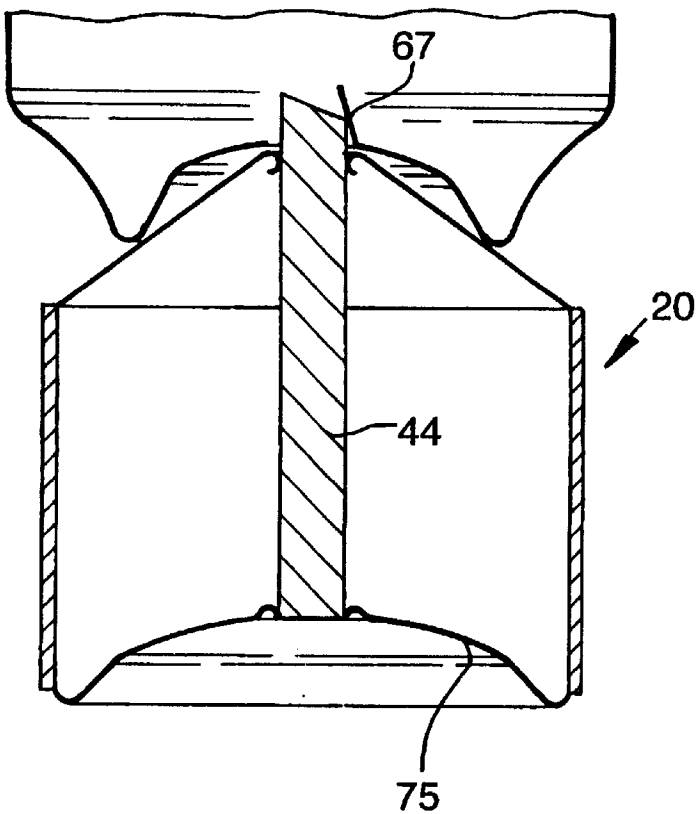
Figure 7A:
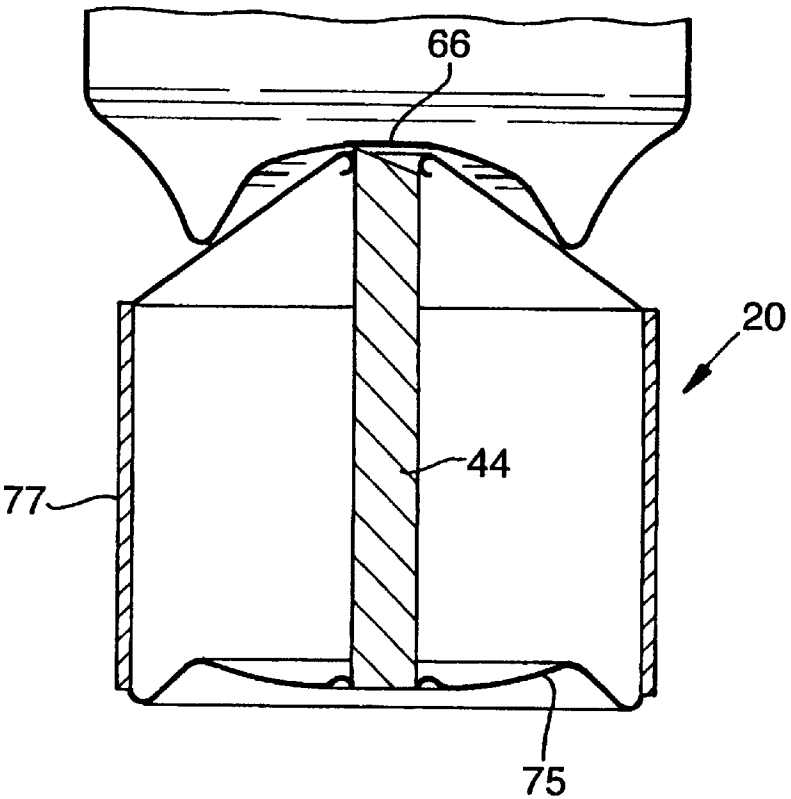
Figure 8:
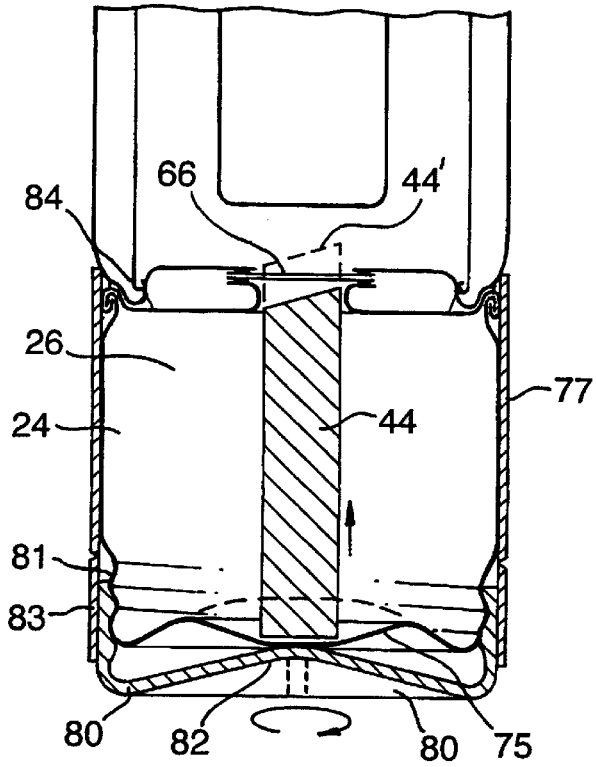
Figure 9A:
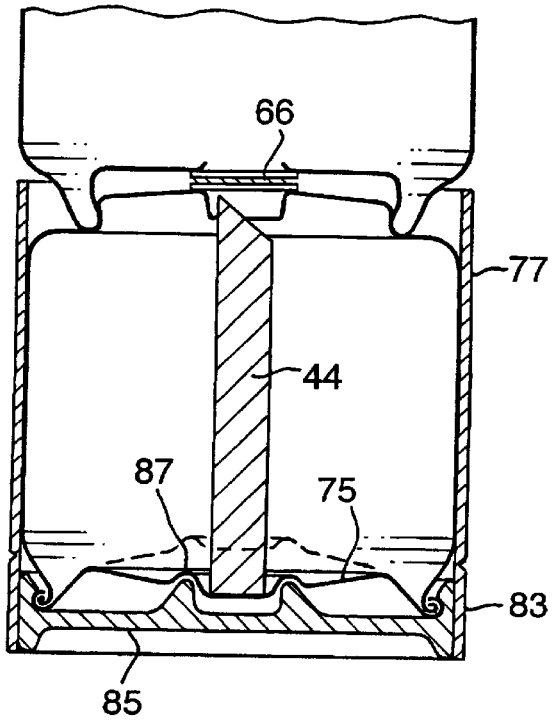
Figure 9B:
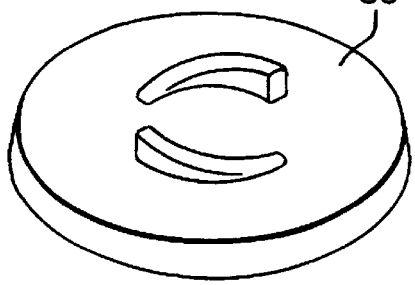
Figure 10:
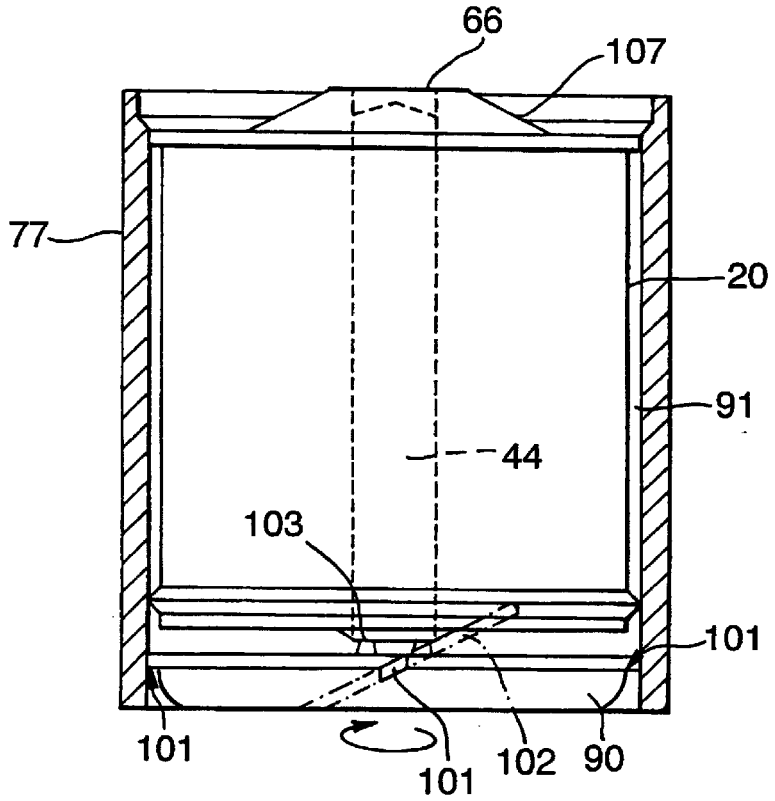
Figure 11:
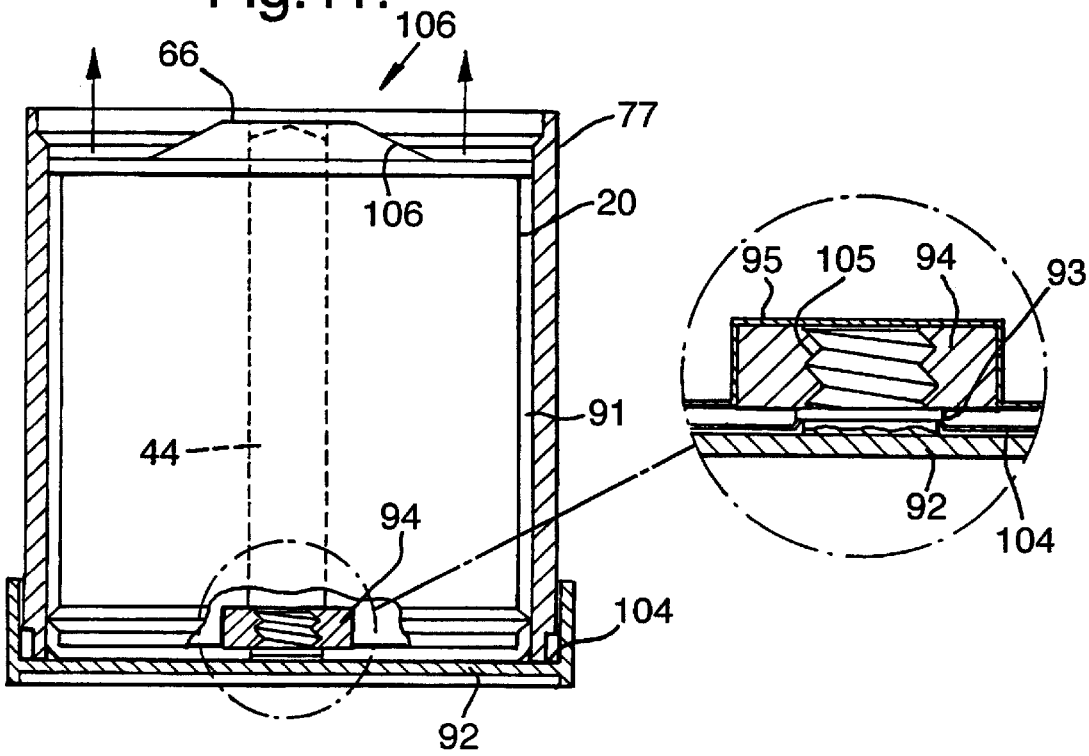
Figure 12:
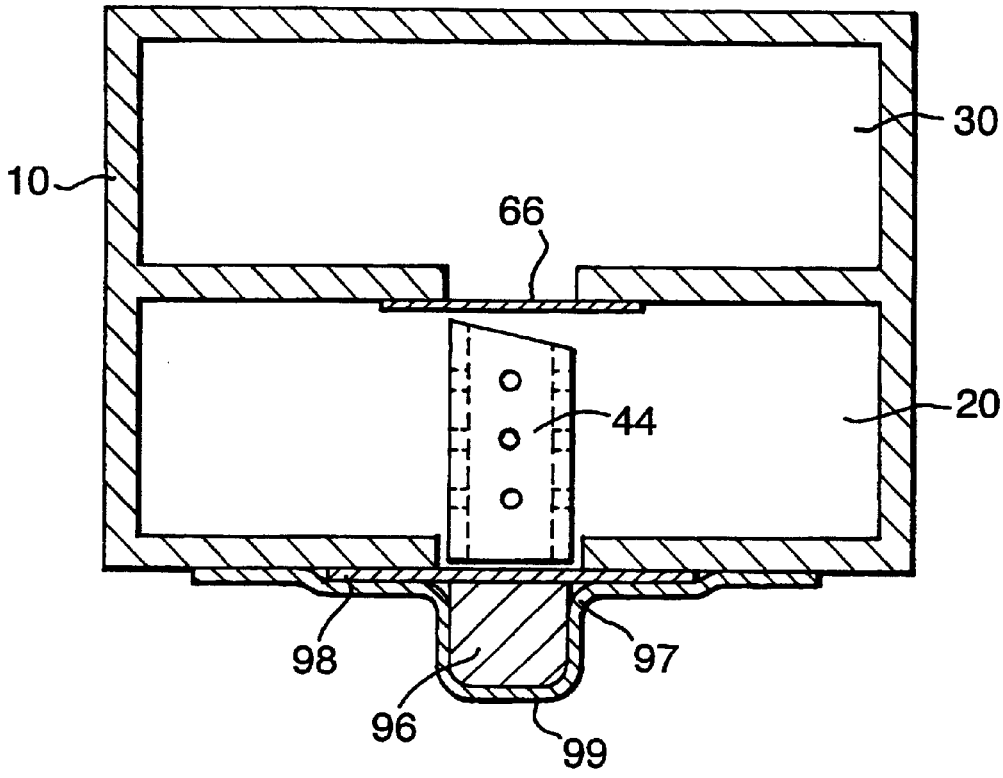
Figure 13:
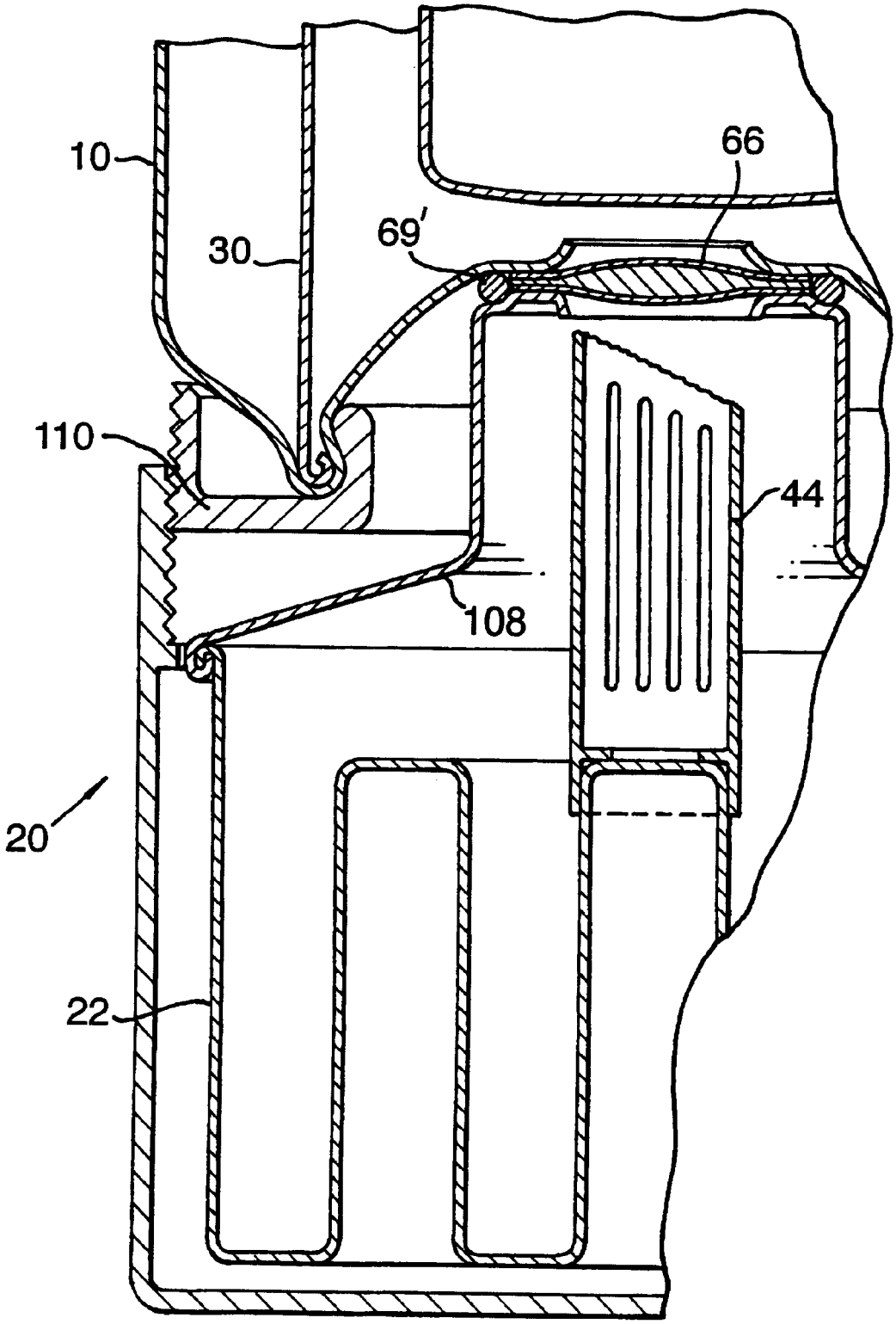
Figure 14:
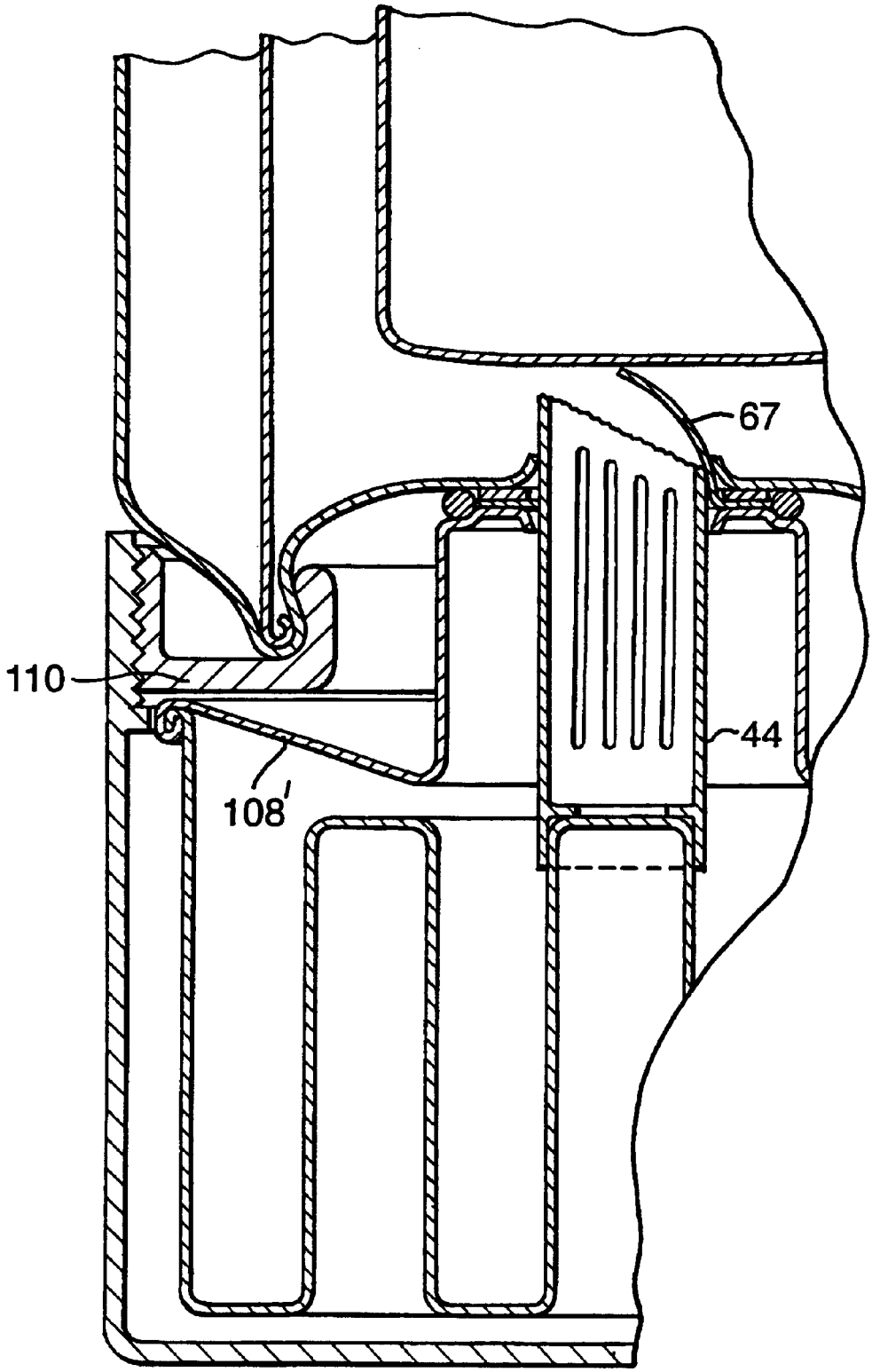

FIGS. 5*a* and 5*b* show an enlarged side view of the structure V of FIG. 4;

FIGS. 6*a* and 6*b* show an enlarged side view of an embodiment of a foil seal;

FIGS. 7*a* and 7*b* show a schematic side view of self-cooling can showing the basic principle of actuation;

FIG. 8 is schematic side view of a self-cooling can showing another embodiment of actuator;

FIGS. 9*a* and 9*b* show a schematic view of a self-cooling can with cam actuation;

FIG. 10 is a schematic side view of a self-cooling can with twist actuation;

FIG. 11 is a schematic side view of a self-cooling can with an alternative twist actuation;

FIG. 12 is a schematic side view of a self-cooling can with axial actuation;

FIG. 13 is a partial side section of another embodiment of self-cooling can; and FIG. 14 is a partial side section of the embodiment of FIG. 13, after actuation.

Figure 1:
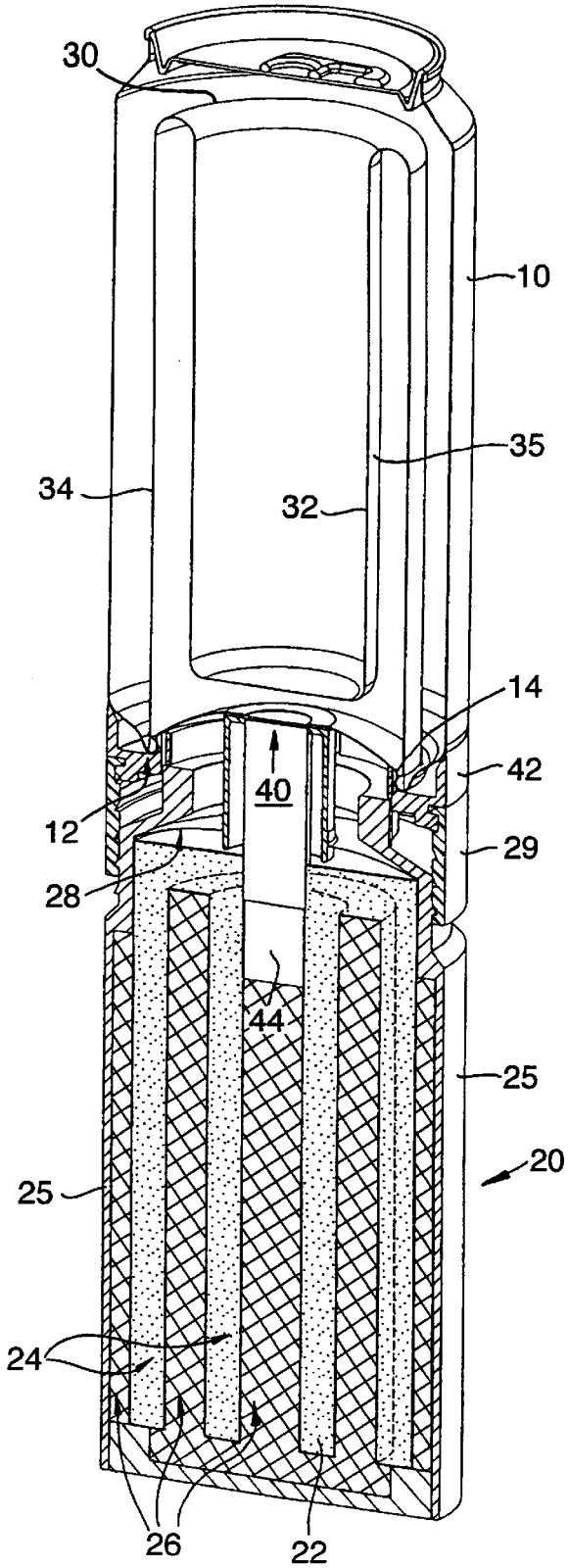
FIG. 1 is a side section perspective view of a self-cooling can assembly according to a first embodiment of the invention.

FIG. 1 shows a first embodiment of self cooling can comprising a can body 10, absorber unit 20 and evaporator 30. The can body has a volume of around 380 ml so as to contain 300 ml of product.

The absorber unit 20 comprises a multi-component fabricated container 22 of 0.16 mm tinplate. Container 22 holds desiccant 24 and is, in turn, placed within a plastic moulded container 25. Container 25 is filled with phase change acetate heat sink material 26.

Desiccant container 22 comprises concentric annuli which are filled with approximately 70 to 130 ml of desiccant 24 so as to ensure a large area of contact with surrounding heat sink material 26. Desiccant container 22 is vacuum seamed to a very high vacuum level by deformable diaphragm 28. A foil/hotmelt adhesive/foil laminate 40, (or other adhesive or sealant) ensures sealing of both the desiccant module and the evaporator element 30 and prevents any air gap between the foils (see FIG. 6 below).

Heat sink acetate material 26 is poured into the insulating container 25 from the base, prior to closing. The insulating container is required to allow a consumer to handle the absorber unit which would otherwise become hot during the cooling of the beverage. Moulded features of insulating container 25 include a rotatable attachment and engagement device for activating the absorber unit.

Evaporator element 30 comprises an annular reverse redrawn component formed from steel or aluminium, coated with lacquer or a polymer such as PET, and has a finished height of 100 mm and diameter of 50 mm. A height of 100 mm places the top of the evaporator approximately 10 mm below the surface of the liquid and is considered to be the minimum necessary to give the optimum cooling surface. The diameter is selected so as to pass through the neck of a 202 diameter can. The gap between the inner and outer walls 32, 34 is kept to a minimum to avoid loss of can volume available for product such as beverage. The inner surface of the evaporator annulus is coated with a film of gel 35. The evaporator element is sealed and clipped into the stand bead 12 of can 10, under a formed ridge 14 in the inside chine wall. The ridge may be formed by internal base reform, for example.

The edge of the evaporator element 32 is curled and beverage-approved water-based sealing compound provided on the inside of the base of the can body between the stand bead 12 of the can and the curl to ensure an hermetic seal. The evaporator curl can either be snap fitted and sealed over the ridge 14, or the evaporator may be secured in position by post-reforming the ridge feature 14 around the evaporator curl. This ensures that the evaporator maintains a high vacuum (necessary to achieve the desired cooling rate for the chilling process) and that the pressure of the beverage will not compromise the seal.

The gel is applied to the evaporator internal surface by flooding with a suspension of the powder in methanol, pouring off the excess and then evaporating the remaining methanol. The dry film is then hydrated by flooding with water and, again, pouring off the excess. A gel film of approximately 0.5 mm is used to carry 10–12 ml of water for cooling the 300 ml of beverage.

The plastic container 25 of the absorber unit 20 is snap fixed to the can via rings 29 and 42, the latter of which is immoveably fixed to the can, for example by a snap fit onto the external surface of ridge 14. Plastic outer ring 29 is threaded to container 25 so as to be rotatable in a screw action. Tubular porous spike 44 sits in its retracted position as shown in FIG. 1 when the absorber is clipped onto the can.

Figure 2:
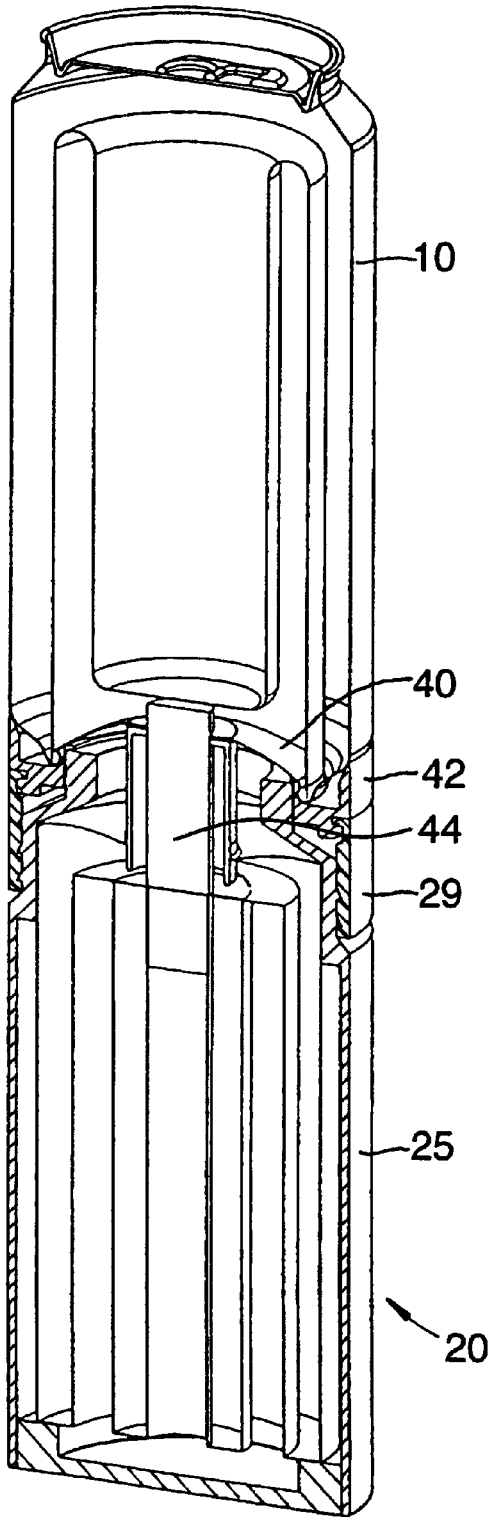
FIG. 2 is the side section of FIG. 1, after activation.

FIG. 2 shows the activated self-cooling can. The absorber unit 20 is clipped onto the can via outer ring 29 and ring 42. The inner wall of ring 29 is screw fitted to container 25. As a result, rotation of the ring 29 causes the whole desiccant container to move axially towards the can. Rotation of the desiccant module is prevented by splines. As the desiccant container moves axially, diaphragm 28 deforms, thereby causing rupture of laminate 40 by porous spike 44. Ultimately, the spike 44 cuts a hole through the laminate and, since the spike tube is porous, provides a path for water vapour to pass from the evaporator to the absorber unit.

Due to the use of a laminate seal and careful filling of the desiccant container under high vacuum, these conditions are maintained after the cooling mechanism has been activated. The consumer need only rotate outer ring 29 of the absorber unit, and, after typically three minutes, the contents of the can are cooled to an ideal drinking temperature. It has been found that a cooling device activated in accordance with the present invention is capable of cooling 300 ml of beverage by 30° F. within 3 minutes.

Figure 3:
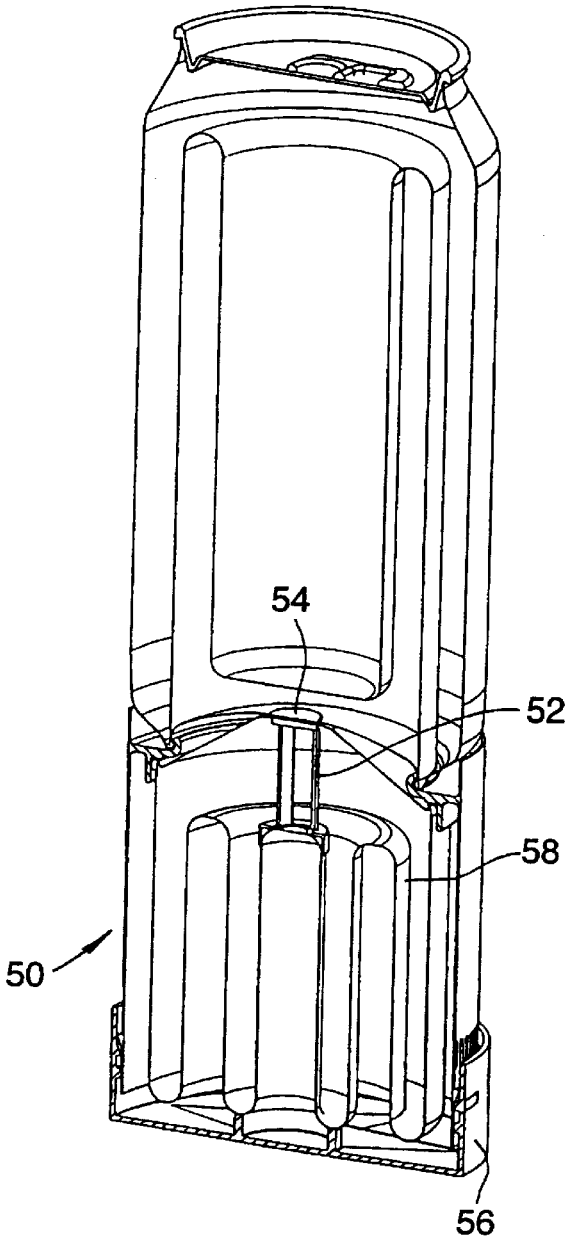
FIG. 3 is a side section perspective view of a second embodiment of the invention.

The embodiment of FIG. 3 operates in a similar manner to the device of FIGS. 1 and 2 in that rotation of part of the absorber unit 50 causes a central spike 52 to move axially and shear a foil/hot melt laminate 54, thereby activating the device.

In this embodiment, rotation is by means of a threaded nut 56 at the base of the absorber unit 50. As the nut rotates, the rotation deforms the desiccant module 58 and pushes the spike 52 through laminate 54.

Another embodiment which uses the concept of rotation of part of the absorber unit to force axial movement of a spike to provide a path from the evaporator to the absorber desiccant module is shown in FIGS. 4 and 5. However, in this device, a cutting element 60 is provided on the base of the evaporator and dome panel 62 is scored either on its interior or exterior surface. The desiccant module is closed by a foil 66 positioned directly beneath the score of the dome panel. A casing 64 for the desiccant module encloses and insulates an acetate heat sink in similar manner to the first two embodiments. Mating of the dome profile 62, foil 66, and a gasket 69, ensures sealing of both vacuum modules and prevents any air gap and leaking during activation.

Activation is achieved by rotation of the whole absorber unit around the face of the can side wall. A multi-start thread 68 provides vertical movement as the absorber is rotated. As the desiccant module moves upwards, cutting element 60 pushes out scored dome panel 62 and the centre 67 of the desiccant module foil 66 (see FIG. 5*b*). A path for vapour from the evaporator unit to the absorber unit is thus provided. The formed ridge 14 in the stand bead of the can is utilised not only to hold the internal evaporator but also to retain the absorber in position.

An enlarged view of the foil seal 66 used for the embodiment shown in FIG. 5 is shown in FIG. 6*a*. The seal 66 comprises two foil layers 70, 71 which contact initially in a central region 72 from which all air has been displaced. Upper foil 70 (for the absorber seal) is cold formed to match a vacuum generated dish on the desiccant can seal 71, or vice versa but in use the foil must be cut from the concave side. A tapered gasket seal 69 may also act as a rotating seal if it is suitably lubricious. The foil thickness is selected so as to be able to resist a vacuum acting over the area of the seal, i.e. 15 psi over ⅜" diameter (1.651 b.f).

Since both the evaporator and absorber units will pull a vacuum, once the layers 70, 71 are fixed to their respective units, they will be pulled apart in the central region 72. Layer 70 will be pulled upwardly by the evaporator and layer 71 by the absorber unit. For a rotating seal, the grease of seal 69 will then penetrate the central space between layers 70 and 71.

The schematic side sections of FIGS. 7*a* and 7*b* show the basic principle of actuation of the present invention. In the figures, the absorber unit 20 includes a cutting tool 44 such as a porous spike, and is closed by a foil/glue/foil laminate 66. The base of the absorber is domed outwardly as shown in FIG. 7*a*. To initiate cooling, the user presses on the base of the absorber unit to cause the bistable dome 75 to evert to its second stable position as shown in FIG. 7*b*. This movement is aided by the vacuum with the absorber. As dome 75 flips upwards, spike 44 penetrates the foil 66, thereby providing a path for water vapour from the evaporator to the desiccant module. The principle of this actuation are utilised in the alternative embodiments of FIGS. 8 to 12.

Although the rotating seal 66 of FIG. 6*a* is suitable for use with any of the embodiments of FIGS. 7 to 12 as well as that of FIG. 5, the simpler fixed (i.e. none rotating) seal of FIG. 6*b* may be used with the embodiments of FIGS. 7 to 12 where no rotation is required of the seal. In this case instead of a grease between the layers 70 and 71, the two layers are fixed together by glue 73.

Similarly, in FIG. 8, a vapour path is made when porous spike 44 penetrates panel 66. In order to initiate this, base cap 80 is rotated as indicated by the arrow in a screwing action around the thread 81 on the desiccant container. Alternatively, a threaded plastic ring may be glued or mechanically fixed to a smooth walled desiccant container and the base cap screwed onto this plastic ring. In this embodiment, the absorber is glued 84 to the base of the can.

A central dimple 82 in the cap 80 presses on the bistable dome 75 of the absorber until, ultimately, the dome 75 flips to the position indicated by the dotted line. When this happens, the spike 44 is forced upwardly to the dotted position 44', thereby creating the vapour path as it ruptures panel 66.

Instead of using a screw thread, in the embodiment of FIG. 9, rotation of the base cap 85 cams the dome 75 upwards using cam profile 86 and complementary mating grooves 87. The converse of this embodiment is also possible. For security, a tamper evident band 83 is usual on outer sleeve 77.

A rotary pusher is provided to actuate cooling when using the absorbers of FIGS. 10 and 11. In FIG. 10, as overcap 90 is rotated, lugs 101 move along helical slots 102 (one shown) in the sleeve 77, causing the activating rotor (cap 90) to rise up. This in turn pushes a bistable button 103 on the base of the absorber can 20 until it flips to an inverted position and hence forces the rigid screen tube spike 44 through a foil panel 66 in the base of the beverage can fixed above the absorber 20, thereby providing a passage for vapour from the evaporator to the absorber. The lid 107 of the absorber unit is rigid and an air gap 91 is provided between the absorber and sleeve 77.

In the embodiment of FIG. 11, a threaded activation ring 92 on the overcap is secured by collar 93 to a metal end 104. Thread 105 on the inside of the overcap mates with a rising nut 94 which, in turn, is push fit into recess 95 in the absorber can base. When the overcap activation ring 92 is twisted, the threaded nut 94 rises, pushing the absorber can within the sleeve 77. As the absorber can rises, collapsible lid 106 is deformed until it flips to its other stable position. As the lid everts, the spiked tube 44 penetrates foil panel 66. Rotation of the absorber can is prevented by any suitable known means.

The self-cooling can shown schematically in FIG. 12 again uses the principle of FIG. 7 but with only a push action to activate cooling. The actuator comprises a hard pellet 96 which is sandwiched in position at the base of porous spike 44 between flexible layer 97 and membrane 98. The membrane 98 prevents the pellet 96 from movement prior to actuation and the membrane and/or layer 97 may also include tamper evidence means. These layers also prevent gas or vapour penetration of the absorber unit from the atmosphere.

To activate cooling, the user pushes on surface 99 of the layer 97 so as to push pellet 96 through the membrane 98. This in turn causes spike 44 to be pushed upwardly through layer 66 and create a vapour path.

Whilst in theory the user could simply push the spike directly or via a single layer such as layer 97, clearly this might risk unwanted gas or vapour penetration which would compromise the vacuum within the absorber, or might result in uncontrolled activation.

FIGS. 13 and 14 show an embodiment similar to that of FIG. 8 but in which the lid 108 of the absorber unit 20 everts for actuation. This is preferable where the absorber includes a rigid desiccant module 22 which is not susceptible to distortion. Foil seal 66 is a rotating seal similar to that of FIG. 6*a* but using an O-ring 69' to ensure that a good seal is maintained and that all air is excluded. A threaded plastic ring clips into the stand bead of the reformed base of the can 10 and has an external screw thread for connecting to complementary thread on the absorber unit.

FIG. 14 shows the movement of the lid 108, spike 44, seal 66 and absorber unit after actuation. As the absorber unit is rotated, it rises up threaded ring 110 until the outer portion of lid 108 everts to position 108' and spike cuts through the foil 66, thereby providing a path for vapour from the evaporator to initiate cooling.

Whilst most of the examples described above use activation from the absorber/base of the can, it is clearly also possible within the scope of the invention to provide a vapour path by top down actuation using activation devices in the can and/or evaporator.

What is claimed is:

1. A self-cooling can having a cylindrical can body and comprising:

an evaporator for cooling a product within the can body;

an absorber unit mounted at least partially on the outside of the can body and including a desiccant container;

a rupturable panel comprising two gas impermeable layers for separating the evaporator from the absorber unit, one layer being bonded to the evaporator and a second layer being bonded to the absorber unit, the two layers contacting each other in a central portion, from which all air is displaced, and being sealed together around the central portion;

one or more seals for preventing gas penetration of the evaporator and/or absorber;

a cutter; and an actuator which includes a deformable member and means for deforming the deformable member;

and in which the rupturable panel comprises two layers of foil sealed together by an adhesive, seal or lubricious grease.

2. A can according to claim 1, in which the seal between the foil layers comprises a gasket, grease or sealant.

3. A can according to claim 1, in which the deformable member is a bistable portion of the absorber unit.

4. A can according to claim 1, in which the cutter comprises a porous spike.

5. A can according to claim 1, in which the deforming means and/or deformable member include a cam profile.

6. A self-cooling can having a cylindrical can body and comprising:

an evaporator for cooling a product within the can body;

an absorber unit mounted at least partially on the outside of the can body and including a desiccant container;

a rupturable panel comprising two gas impermeable layers for separating the evaporator from the absorber unit, one layer being bonded to the evaporator and a second layer being bonded to the absorber unit, the two layers contacting each other in a central portion, from which all air is displaced, and being sealed together around the central portion;

one or more seals for preventing gas penetration of the evaporator and/or absorber;

a cutter; and an actuator which includes a deformable member and means for deforming the deformable member;

and in which a seal between the layers comprises a gasket, grease or sealant.

7. A can according to claim 6, in which the deformable member is a bistable portion of the absorber unit.

8. A can according to claim 6, in which the cutter comprises a porous spike.

9. A can according to claim 6, in which the deforming means and/or deformable member include a cam profile.

10. A self-cooling can having a cylindrical can body and comprising:

an evaporator for cooling a product within the can body;

an absorber unit mounted at least partially on the outside of the can body and including a desiccant container;

a rupturable panel comprising two gas impermeable layers for separating the evaporator from the absorber unit, one layer being bonded to the evaporator and a second layer being bonded to the absorber unit, the two layers contacting each other in a central portion, from which all air is displaced, and being sealed together around the central portion;

one or more seals for preventing gas penetration of the evaporator and/or absorber;

a cutter; and an actuator which includes a deformable member and means for deforming the deformable member;

and in which the rupturable panel comprises two layers of foil sealed together by a seal.

11. A can according to claim 10, in which the seal between the foil layers comprises a gasket, grease or sealant.

12. A can according to claim 10, in which the deformable member is a bistable portion of the absorber unit.

13. A can according to claim 10, in which the cutter comprises a porous spike.

14. A can according to claim 10, in which the deforming means and/or deformable member include a cam profile.

15. A self-cooling can having a cylindrical can body and comprising:

an evaporator for cooling a product within the can body;

an absorber unit mounted at least partially on the outside of the can body and including a desiccant container;

a rupturable panel comprising two gas impermeable layers for separating the evaporator from the absorber unit, one layer being bonded to the evaporator and a second layer being bonded to the absorber unit, the two layers contacting each other in a central portion, from which all air is displaced, and being sealed together around the central portion;

one or more seals for preventing gas penetration of the evaporator and/or absorber;

a cutter; and an actuator which includes a deformable member and means for deforming the deformable member;

and in which the rupturable panel comprises two layers of foil sealed together by an adhesive.

16. A can according to claim 15, in which the deformable member is a bistable portion of the absorber unit.

17. A can according to claim 15, in which the cutter comprises a porous spike.

18. A can according to claim 15, in which the deforming means and/or deformable member include a cam profile.

19. A self-cooling can having a cylindrical can body and comprising:

an evaporator for cooling a product within the can body;

an absorber unit mounted at least partially on the outside of the can body and including a desiccant container;

a rupturable panel comprising two gas impermeable layers for separating the evaporator from the absorber unit, one layer being bonded to the evaporator and a second layer being bonded to the absorber unit, the two layers contacting each other in a central portion, from which all air is displaced, and being sealed together around the central portion;

one or more seals for preventing gas penetration of the evaporator and/or absorber;

a cutter; and an actuator which includes a deformable member and means for deforming the deformable member;

and in which the rupturable panel comprises two layers of foil sealed together by a lubricious grease.

20. A can according to claim 19, in which the deformable member is a bistable portion of the absorber unit.

21. A can according to claim 19, in which the cutter comprises a porous spike.

22. A can according to claim 19, in which the deforming means and/or deformable member include a cam profile.

* * * * *